US005643140A

United States Patent [19]

Tsai

[11] Patent Number: 5,643,140

[45] Date of Patent: Jul. 1, 1997

[54] SWING EXERCISER

[76] Inventor: Chien-lung Tsai, No. 7, Lane 46, Talien N. Rd., Peitun Dist., Taichung, Taiwan

[21] Appl. No.: 717,634

[22] Filed: Sep. 23, 1996

[51] Int. Cl.[6] ..... A63B 22/00

[52] U.S. Cl. ..... 482/51; 482/52

[58] Field of Search ..... 482/51, 52, 53, 482/54, 70, 74, 79, 129, 130, 148; 434/255

[56] References Cited

U.S. PATENT DOCUMENTS

| | | | |
|---|---|---|---|
| 4,850,585 | 7/1989 | Dalebout et al. | 482/70 |
| 4,861,023 | 8/1989 | Wedman | 482/51 |
| 4,940,233 | 7/1990 | Bull et al. | 482/52 |
| 4,989,858 | 2/1991 | Young et al. | 482/53 |
| 5,000,443 | 3/1991 | Dalebout et al. | 482/52 |
| 5,419,747 | 5/1995 | Piaget et al. | 482/51 |
| 5,496,235 | 3/1996 | Stevens | 482/51 |
| 5,584,780 | 12/1996 | Lin | 482/51 |

*Primary Examiner*—Stephen R. Crow
*Attorney, Agent, or Firm*—Welsh & Katz, Ltd.

[57] ABSTRACT

A swing exerciser includes two stands with a shaft rotatable disposed therebetween, each one of the two stands having a swing member with one end thereof pivotally connected to the stand and the other end of the swing member having a plate, each of the two swing members having a link assembly pivotally connected thereto and the other end of each of the link assemblies fixedly and diametrically connected to a respective one of two ends of the shaft such that when a user swings one swing member, the other swing member is rotated in an opposite direction by a rotation of the shaft.

4 Claims, 5 Drawing Sheets

SWING EXERCISER

BACKGROUND OF THE INVENTION

1. Field of the Invention

The present invention relates to a swing exerciser and more particularly, to a swing exerciser having two stands each with two foot members, and a shaft pivotally extending therebetween, the two foot members each having a respective link assembly which is connected to the shaft such that when one foot member is swung, the other one will be swung by the shaft simultaneously.

2. Brief Description of the Prior Art

Generally, exercisers are designed to let users use their muscles to overcome the resistance of a mechanism of the exercisers in order to achieve a purpose of training muscles. Although the resistance can be adjusted, it is still not proper for a child or an older user to use.

Therefore, there has been a long and unfulfilled need for an exerciser having a small resistance so that children or older users can operate the exerciser with ease.

SUMMARY OF THE INVENTION

The present invention provides a swing exerciser which comprises a first stand having a first upper rod and a first lower rod transversely disposed thereto and a second stand having a second upper rod and a second lower rod disposed transversely thereto. A first swing member has one end pivotally connected to the first upper rod and the other end thereof having a first plate disposed thereto. A second swing member has one end pivotally connected to the second upper rod and the other end of the second swing member has a second plate disposed thereto.

A shaft is rotatably connected between the first stand and the second stand.

A first link assembly comprises a first long link which has one end thereof pivotally connected to the first swing member and a first short link which has one end thereof fixedly connected to the shaft. The other end of each of the first long link and the first short link are pivotally connected with each other.

A second link assembly comprises a second long link which has one end thereof pivotally connected to the second swing member and a second short link which has one end thereof fixedly connected to the shaft. The other end of each of the second long link and the second short link are pivotally connected with each other. A pivotal point between the first short link and the first long link is located above the shaft and a pivotal point between the second short link and the second long link is located beneath the shaft.

It is an object of the present invention to provide a swing exerciser which is operated with ease.

It is another object of the present invention to provide a swing exerciser which is suitable for children and older people to use.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
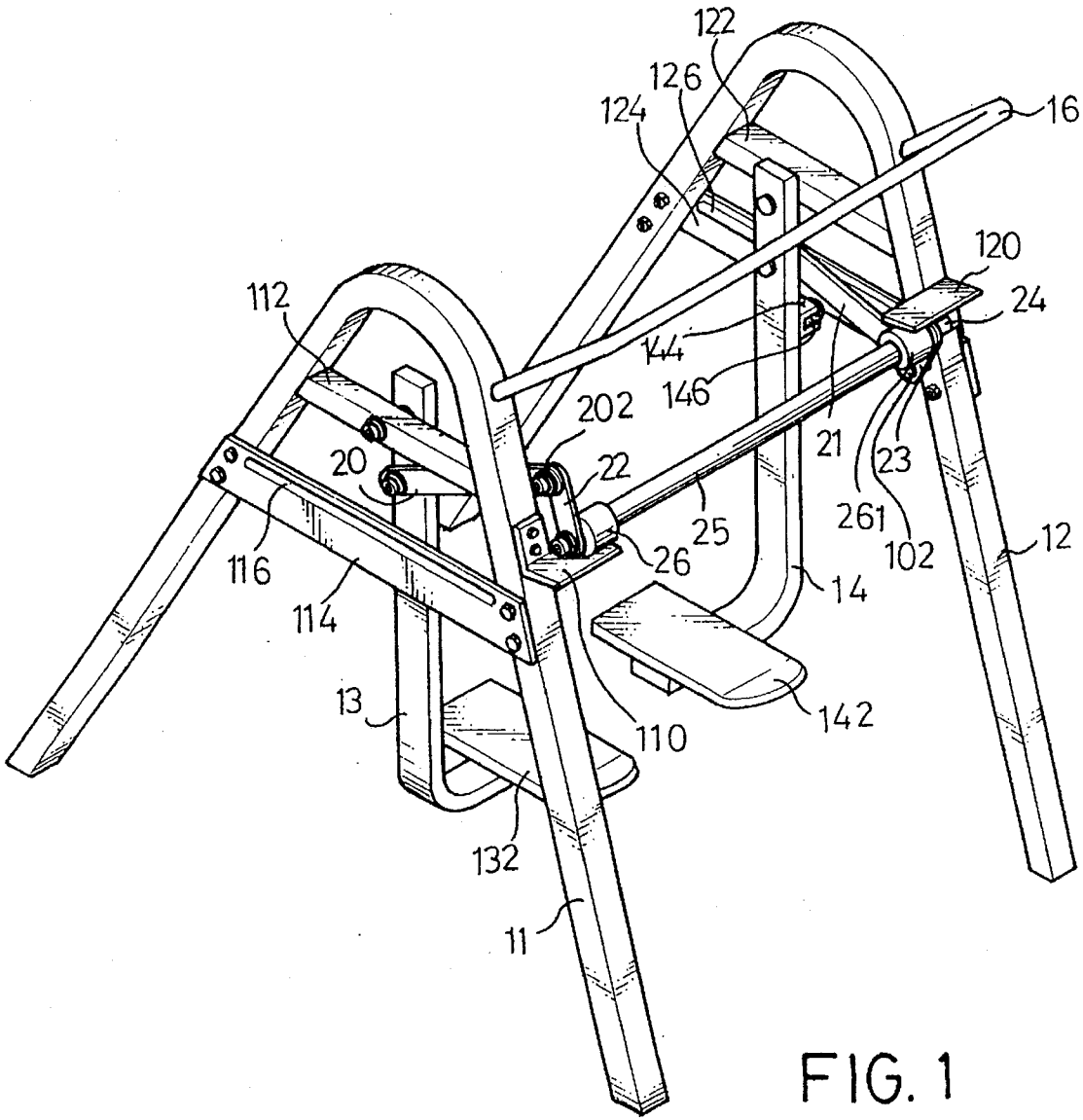
FIG. 1 is a perspective view of a swing exerciser in accordance with the present invention.
Figure 2:
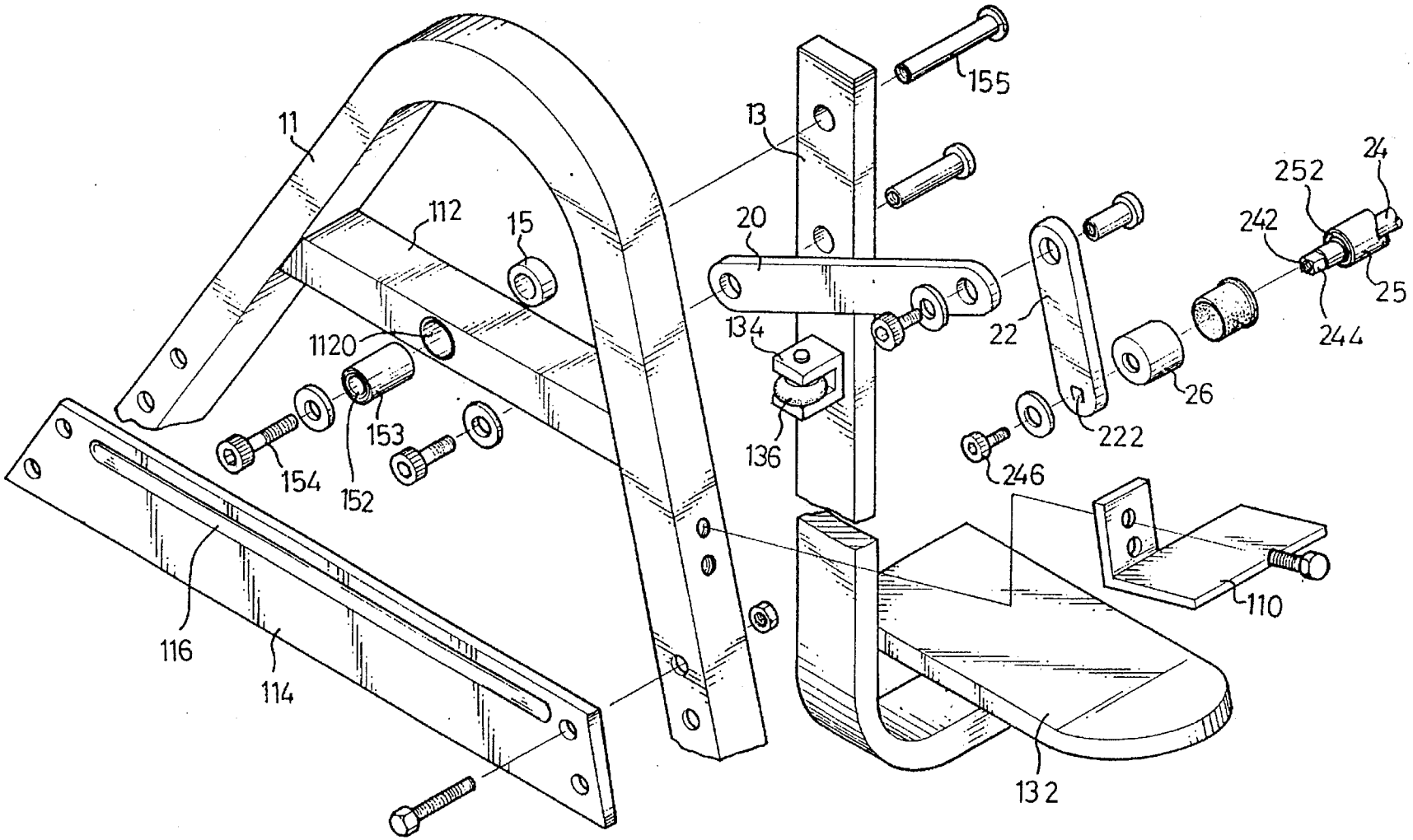
FIG. 2 is an exploded view of one side of the swing exerciser in accordance with the present invention.
Figure 3:
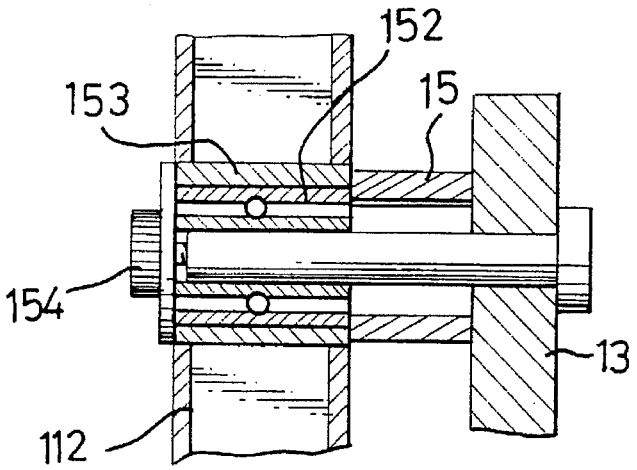
FIG. 3 is a side elevational view, partly in section, to show an engagement between the swing member and the upper rod to which the swing member is pivotally connected.
Figure 4:
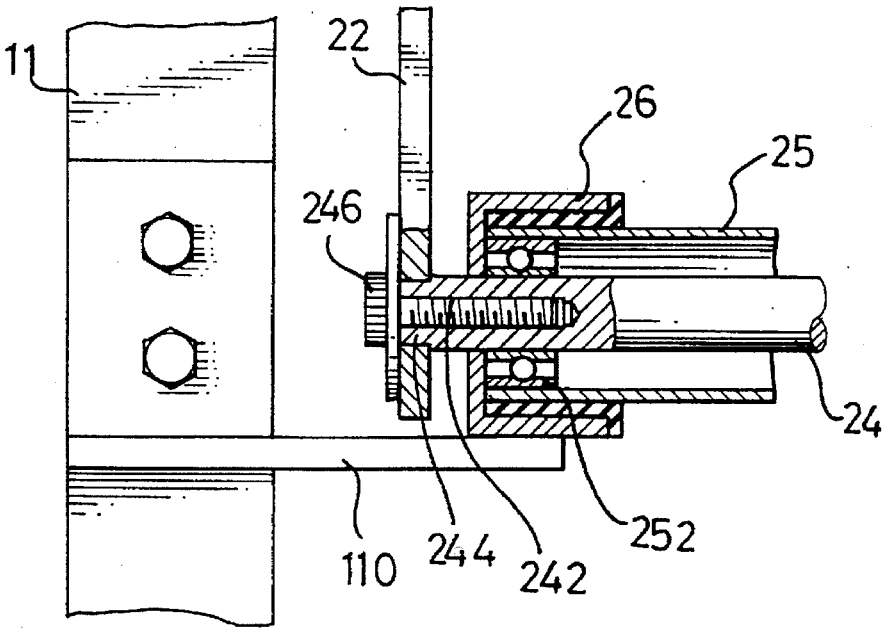
FIG. 4 is a side elevational view, partly in section, to show an engagement between the first short link and the shaft.

Referring to the drawings and initially to FIGS. 1 through 4, a swing exerciser in accordance with the present invention generally includes a first stand 11 and a second stand 12, the first stand 11 having a first upper rod 112 and a first lower rod 114 transversely disposed thereto, the second stand 12 having a second upper rod 122 and a second lower rod 124 disposed transversely thereto so that both of the first stand 11 and the second stand 12 are shaped as an "A".

A first swing member 13 being an L-shaped member has one end pivotally connected to the first upper rod 112 and the other end of the first swing member 13 has a first plate 132 disposed thereto. The first upper rod 112 has a hole 1120 defined therein in which a bearing 152 with a bush 153 are inserted, a separator 15 is disposed between the first upper rod 112 and the first swing member 13 such that a bolt 154 extends through the bearing 152 and the separator 15 and threadedly engages with a threaded tube 155 which extends through the first swing member 13 and the bearing 152. The first swing member 13 has a first roller 136 rotatably disposed in a bracket 134 which is fixedly disposed to an outer side of the first swing member 13 such that the first roller 136 can roll on the first lower rod 114. A second swing member 14 being an L-shaped member has one end pivotally connected to the second upper rod 122 in the same way as that described regarding to the first swing member 13 and the other end of the second swing member 14 has a second plate 142 disposed thereto such that a user (see FIG. 6) can stand both of his feet on the first plate 132 and the second plate 142. The second swing member 14 has a second roller 146 rotatably disposed in a bracket 144 which is fixedly disposed to an outer side of the second swing member 14 so as to roll the second roller 146 on the second lower rod 124.

Each of the first lower rod 114 and the second lower rod 124 has a stop strip 116/126 extending laterally therefrom so as to respectively limit the first roller 136 and the second roller 146 from rolling over the first lower rod 114 and the second lower rod 124.

A shaft 24 has a square end 244 formed in each one of two ends thereof and the shaft 24 is received in a casing 25 with a bearing 252 disposed between the casing 25 and the two square ends 244 each extend out from a corresponding end of the casing 25. A first support 110 being a flat board is fixedly connected to the first stand 11 and a second support 120 being a flat board is fixedly connected to the second stand 12. A first short tube 26 is fixedly disposed to an upper surface of the first support 110 and a second short tube 261 is fixedly disposed to an under surface of the second support 120.

A first link assembly comprises a first long link 20 which has one end thereof pivotally connected to the first swing member 13 at a position between the first upper rod 112 and the first lower rod 114, and a first short link 22 which has one end thereof with a square hole 222 mounted to the square end 244 corresponding thereto and a bolt 246 threadedly connected to a threaded hole 242 defined in the square end 244. The other end of each of the first long link 20 and the first short link 22 are pivotally connected with each other by a bolt and a threaded tube.

A second link assembly comprises a second long link 21 which has one end thereof pivotally connected to the second swing member 14 at a position between the second upper rod 122 and the second lower rod 124, and a second short link 23 which has one end thereof fixedly connected to the square end 244 corresponding thereto in the same way as that described regarding to the first short link 22. The other end of each of the second long link 21 and the second short link 23 are pivotally connected with each other. A pivotal point 202 between the first short link 22 and the first long link 20 is located above the shaft 24 and a pivotal point 102 between the second short link 23 and the second long link 21 is located beneath the shaft 24.

Figure 5:
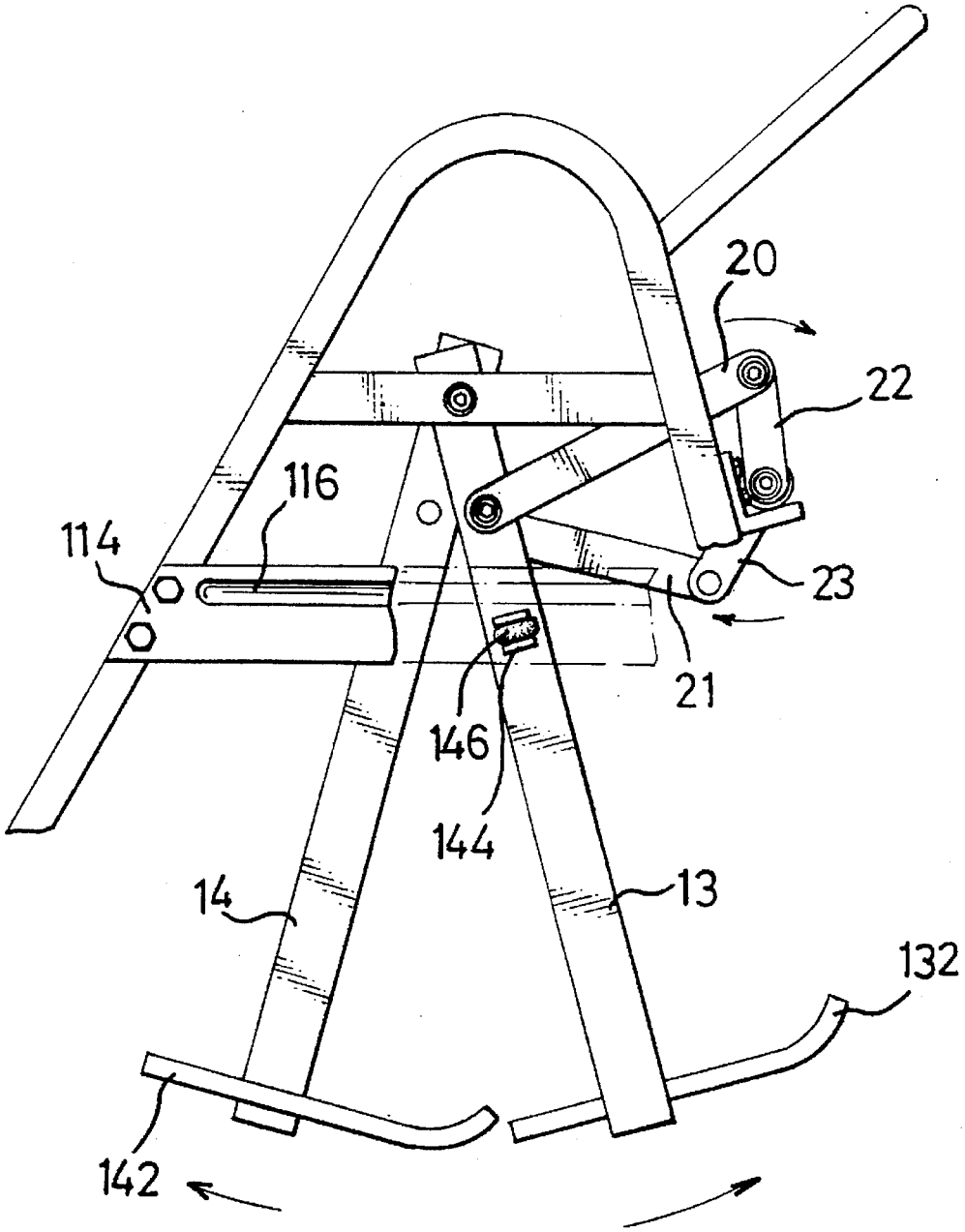
FIG. 5 is an illustrative view to show a movement of the two swing members.
Figure 6:
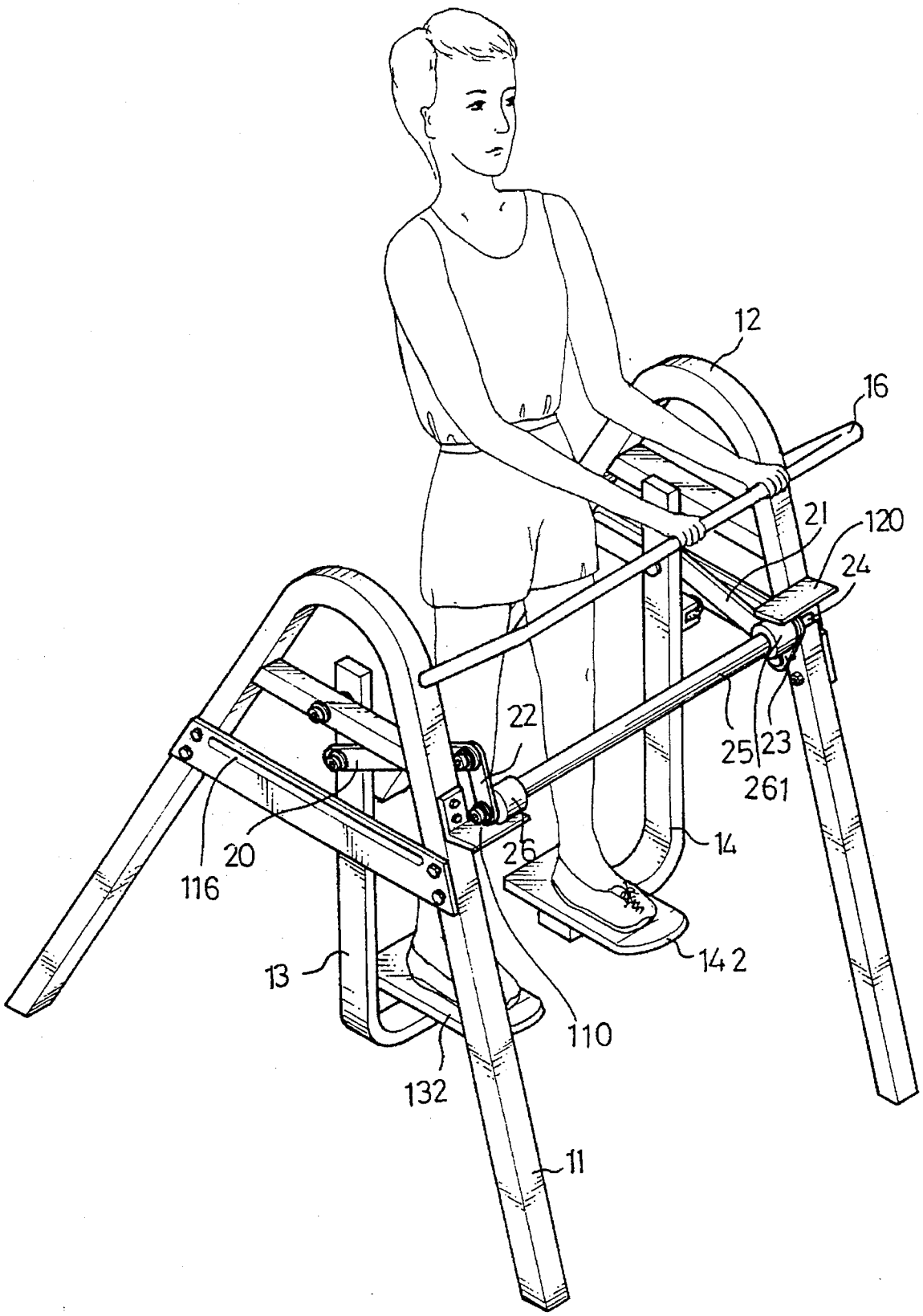
FIG. 6 is a perspective view to show a user standing on the plates of the two swing members with both his hands holding a frame between the two stands.

Referring to FIGS. 5 and 6, a user stands both his feet on the first plate 132 and the second plate 142 with his hands holding on a frame 16 connected between the first stand 11 and the second stand 12. When the user pushes his right leg towardly, the shaft 24 is rotated clockwise when viewed from right side of the user by the first link assembly, the second link assembly is actuated simultaneously by a rotation of the shaft 24 and the second swing member 14 is swung rearwardly, Thus, the user can operate the exerciser with limited force.

Although the invention has been explained in relation to its preferred embodiment, it is to be understood that many other possible modifications and variations can be made without departing from the spirit and scope of the invention as hereinafter claimed.

What is claimed is:

1. A swing exerciser comprising:

a first stand and a second stand, said first stand having a first upper rod and a first lower rod transversely disposed thereto, said second stand having a second upper rod and a second lower rod disposed transversely thereto;

a first swing member having one end pivotally connected to said first upper rod and the other end of said first swing member having a first plate disposed thereto, a second swing member having one end pivotally connected to said second upper rod and the other end of said second swing member having a second plate disposed thereto;

a shaft rotatably connected between said first stand and said second stand;

a first link assembly comprising a first long link which has one end thereof pivotally connected to said first swing member and a first short link which has one end thereof fixedly connected to said shaft, the other end of each of said first long link and said first short link being pivotally connected with each other, and a second link assembly comprising a second long link which has one end thereof pivotally connected to said second swing member and a second short link which has one end thereof fixedly connected to said shaft, the other end of each of said second long link and said second short link being pivotally connected with each other wherein a pivotal point between said first short link and said first long link is located above said shaft and a pivotal point between said second short link and said second long link is located beneath said shaft.

2. The swing exerciser as claimed in claim 1 wherein said first swing member has a first roller disposed to an outer side thereof so as to roll on said first lower rod and said second swing member has a second roller disposed to an outer side thereof so as to roll on said second lower rod.

3. The swing exerciser as claimed in claim 2 wherein each of said first lower rod and said second lower rod has a stop extending laterally therefrom so as to respectively limit said first roller and said second roller from rolling over said first lower rod and said second lower rod.

4. The swing exerciser as claimed in claim 1 wherein a frame connected between said first stand and said second stand.

* * * * *